US006923326B2

(12) United States Patent
Lackey et al.

(10) Patent No.: US 6,923,326 B2
(45) Date of Patent: Aug. 2, 2005

(54) STORAGE AND MERCHANDISING CONTAINER

(75) Inventors: Robert W. Lackey, Hickory, NC (US); Roy V. Nicholson, Blowing Rock, NC (US)

(73) Assignee: RWL Corporation, Hickory, NC (US)

( * ) Notice: Subject to any disclaimer, the term of this patent is extended or adjusted under 35 U.S.C. 154(b) by 86 days.

(21) Appl. No.: 10/659,526

(22) Filed: Sep. 9, 2003

(65) Prior Publication Data

US 2005/0051460 A1 Mar. 10, 2005

(51) Int. Cl.[7] ..... B65D 85/52
(52) U.S. Cl. ..... 206/736; 206/459.5; 206/449
(58) Field of Search ..... 206/459.5, 736, 206/526, 499, 767, 449

(56) References Cited

U.S. PATENT DOCUMENTS

| | | | | | |
|---|---|---|---|---|---|
| 2,675,123 | A | * | 4/1954 | Baird | 206/526 |
| 2,725,978 | A | | 12/1955 | Calabrese | 206/45 |
| 3,417,861 | A | | 12/1968 | Levy | 206/45.28 |
| 3,858,717 | A | | 1/1975 | Peters | 206/44.12 |
| 4,567,981 | A | * | 2/1986 | Headon | 206/597 |
| 4,762,226 | A | * | 8/1988 | Gatton | 206/320 |
| 5,175,041 | A | * | 12/1992 | Webb et al. | 428/116 |
| 5,249,669 | A | | 10/1993 | Resnick et al. | 206/45.15 |
| 5,370,233 | A | * | 12/1994 | Schutz et al. | 206/597 |
| 5,509,533 | A | | 4/1996 | Veenstra | 206/425 |
| 5,657,872 | A | | 8/1997 | Leftwich et al. | 206/738 |
| 5,706,953 | A | | 1/1998 | Polvere | 206/736 |
| 5,850,922 | A | | 12/1998 | Fraser | 206/736 |
| 5,866,181 | A | * | 2/1999 | Hill | 426/107 |

* cited by examiner

*Primary Examiner*—David T. Fidei
(74) *Attorney, Agent, or Firm*—Charles L. Schwab; Nexsen Pruet, LLC

(57) ABSTRACT

A box shaped merchandising container includes a product information panel which is exposed when a cover is removed from one end of an enclosure. The information panel is disposed at a corner of a rectangular open end of the enclosure and is dimensioned to permit flat merchandise, such as home type air filters, to be withdrawn from the enclosure without destructive effect on the information panel.

3 Claims, 4 Drawing Sheets

STORAGE AND MERCHANDISING CONTAINER

BACKGROUND OF THE INVENTION

The invention relates to a container for storing and merchandising a plurality of flat box shaped articles. Efficient movement of goods from point of manufacture to the purchaser reduces the cost of the goods to the ultimate purchaser. The cut case display of goods is increasing favored because the goods can be moved to and displayed at the merchant's display area more efficiently and the goods are better protected during movement and while on display. U.S. Pat. No. 5,509,533 issued Apr. 23, 1996 to H. Veenstra for a Package for Storing and Displaying a Plurality of Box-Shaped Articles, More Particularly Data Carriers Such as Floppy Disks and the Like discloses a display container which includes a plurality of sheathes for receiving box shaped articles such as floppy disks and which permit product display in the style of overlapping roof tiles. U.S. Pat. No. 5,249,669 issued Oct. 5, 1993 to M. Resnick et al. for a Display Container shows a container which has an upper top opening compartment and a lower sliding drawer. U.S. Pat. No. 3,858,717 issued Jan. 7, 1975 to L. Peters for a Container for Perishable Foods discloses a merchandising container for perishable foods which is equipped with pull tabs to aid in removal of items from shelves of the container.

SUMMARY OF THE INVENTION

This invention provides a container for shipping, storing and displaying merchandise such as home type air filters which includes an information panel in one corner of an opening which is exposed when the selling merchant removes an end cap from the container. The information panel is dimensioned and positioned to allow a customer to withdraw individual items, such as filters, from the container.

BRIEF DESCRIPTION OF THE DRAWINGS

One embodiment of the invention is illustrated in the accompanying drawings in which.

DETAILED DESCRIPTION OF THE INVENTION

Figure 1:
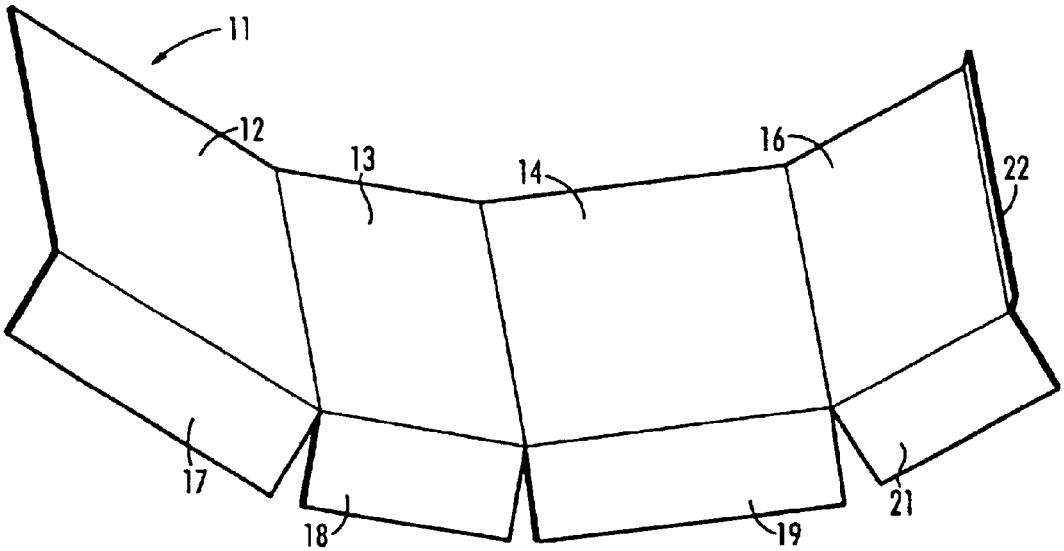
FIG. 1 shows a corrugated cardboard panel cut to form a container.

The drawings illustrate a special display container for flat box shaped home air filters, the steps of making the container and the manner of use of the container in displaying the air filter in a merchants place of business. FIG. 1 shows a piece of conjugated card board component 11 cut and creased to form four quadrilateral sides 12, 13, 14, 16, four bottom flaps 17, 18, 19, 21 and a side flap 22.

Figure 2:
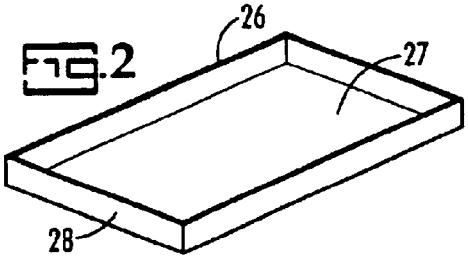
FIG. 2 shows a cap formed for the container.
Figure 3:
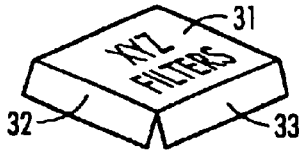
FIG. 3 shows an unattached information panel.

FIG. 2 shows a cap 26 having a quadrilateral top panel 27 and a rectangular collar 28 extending at right angles to the top panel 27. FIG. 3 shows an information panel 31 which preferably identifies the goods and the manufacturer by name and/or trademark and may also include other helpful information such as dimensions or model number. The information panel 31 is provided with a pair of flaps 32, 33 on adjacent sides of the panel 31.

Figure 4:
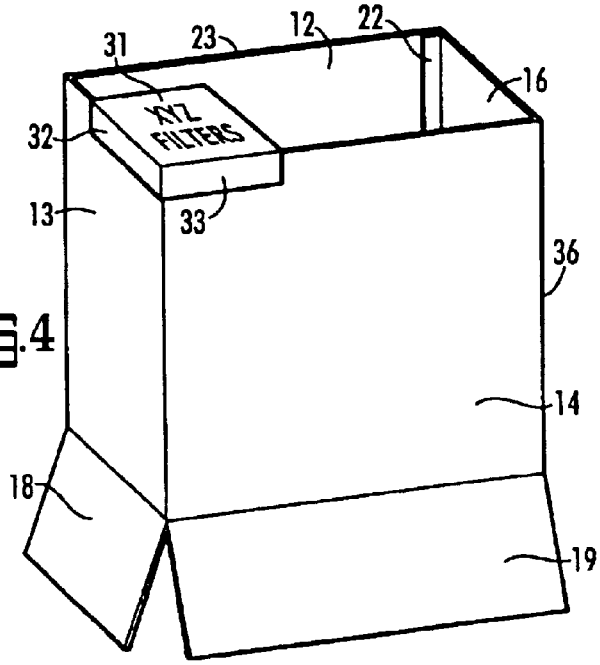
FIG. 4 shows the panel of FIG. 1 folded to form an enclosure with an open end to which the information panel is installed.
Figure 5:
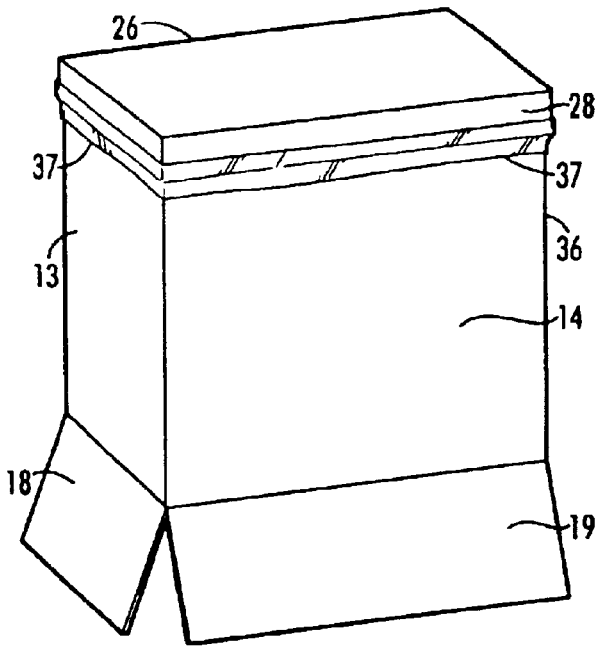
FIG. 5 shows the cap placed over the information panel at the open end.
Figure 6:
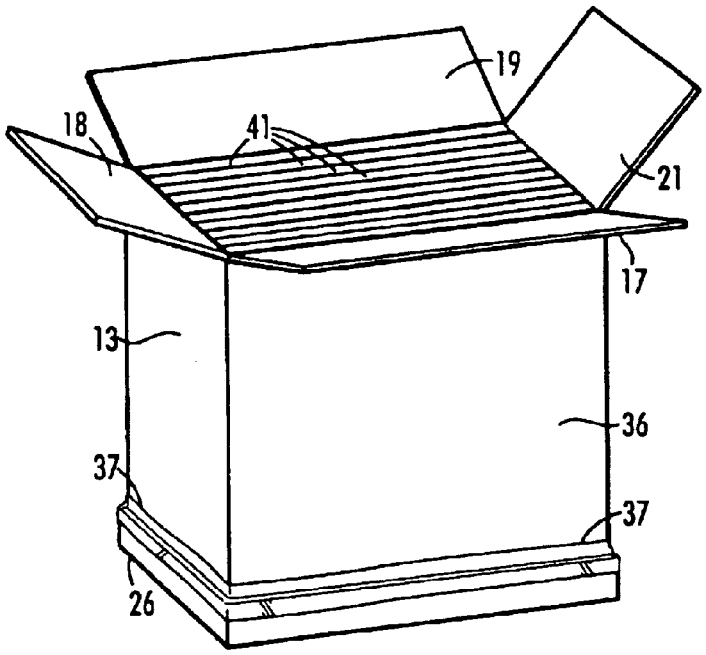
FIG. 6 shows the container in an inverted position with merchandise inserted therein.
Figure 7:
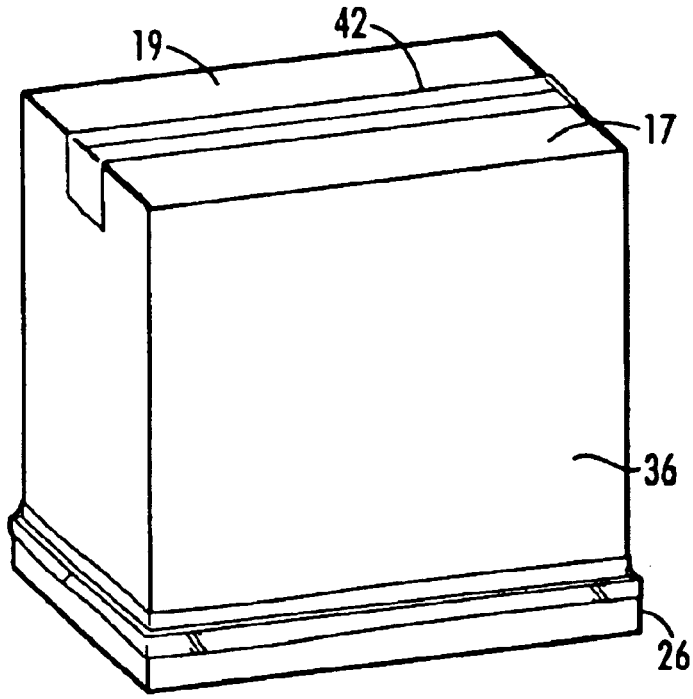
FIG. 7 shows the container sealed and ready for shipment or storage.
Figure 8:
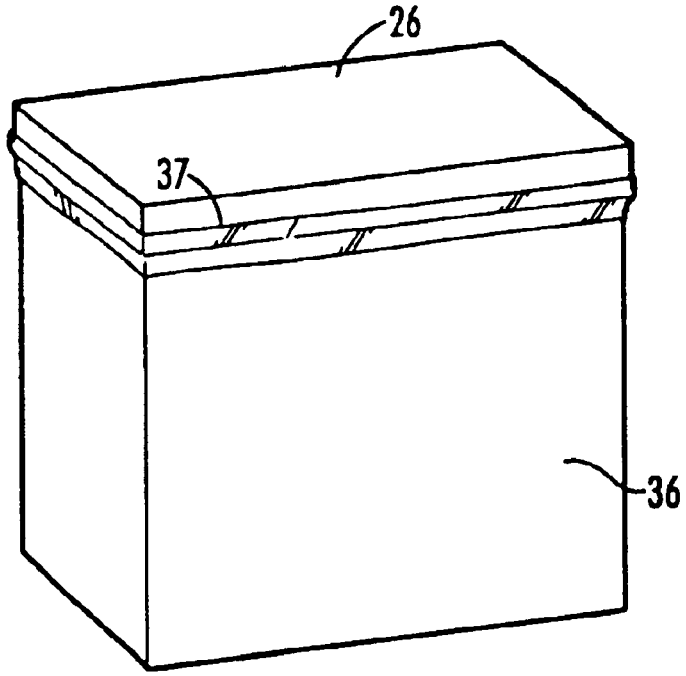
FIG. 8 shows the container positioned with its cap on top.

FIG. 4 shows an enclosure 36 being formed from the card board component 11 by gluing the flap 22 to the side 12 and also shows the information panel 31 secured in place in a corner of a rectangular opening 23 defined by the upper edges of the vertical rectangular panels or sides 12, 13, 14, 16. The flaps 32, 33 of the information panel 31 are glued, or otherwise secured, to the adjoined adjacent or contiguous sides or panels 13, 14 of the box or enclosure 36. The edges of the information channel 31 remote from its flaps 32, 33 are spaced from and parallel to side panels 12 and 16, respectively. The spacing between the edge of the information panel 31 and the side 12 is at least slightly wider than the thickness of the thin stratal positioned merchandise items or filters 41 for home heating and cooling systems. In the next step in the process of manufacture of the container, which is illustrated in FIG. 5, the cap 26 is placed over the opening 23 and the information panel 31 and its collar 28 is fastened, preferably by transparent tape 37 to the sides 12, 13, 14, 16. The container thus formed is next turned upside down and a plurality of home type air filters 41 are inserted into the container as shown in FIG. 6. In the next step, the flaps 17, 18, 19, 21 are folded and secured by tape 42 to close the container, as shown in FIG. 7. FIG. 8 shows the filled container in an upright position ready for storage or shipment to a merchant.

Figure 9:
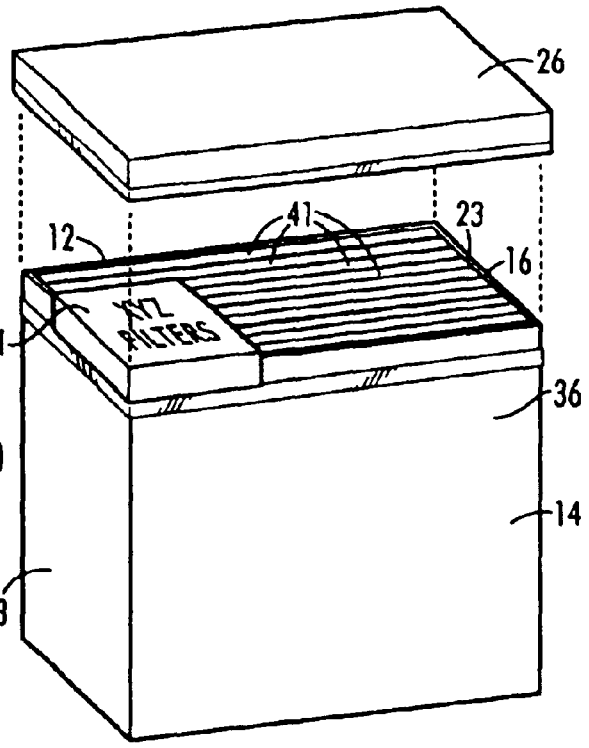
FIG. 9 shows the container with the cap removed.
Figure 10:
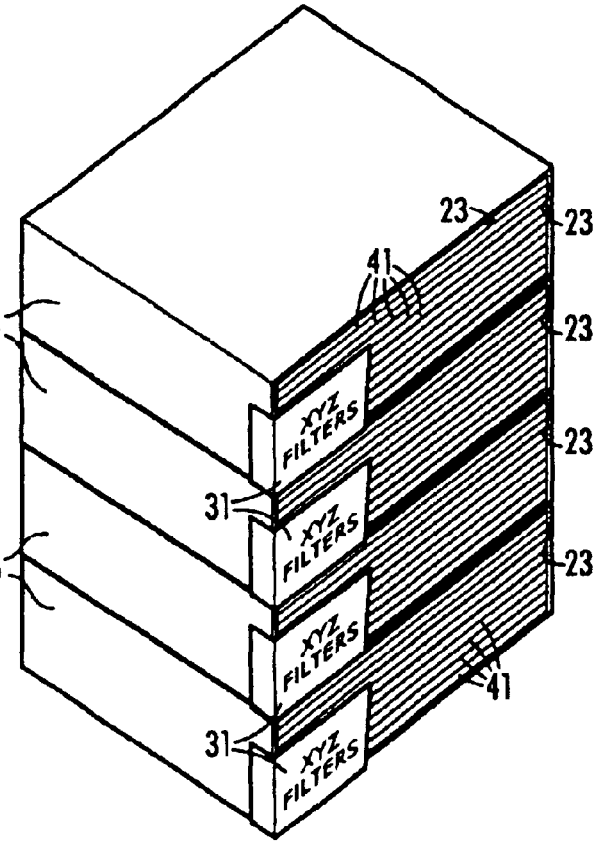
FIG. 10 shows a plurality of opened containers stacked one on top of another with the flat air filters therein lying horizontal.

After receipt of the merchandise by the retailer, the container may be opened by cutting the tape 37 by which the cap 26 is secured to the enclosure 36 and by removing the cap 26, as shown in FIG. 9. The enclosures may now be stacked for display of the juxtaposed filters 41 as shown in FIG. 10. The upper edge of information panels 31 in the lower left hand corner of their openings 23 terminates is parallel to the air filters 41 and parallel to the side 12 of the enclosures 36. This spacing of the upper edge of the information panel 31 from the side 12 of the enclosure 36 provides a gap of about two or three times the thickness of an air filter 41. This spacing permits a customer to easily remove the top air filter from an enclosure 36 without destructive effect on the information panel 31.

The herein disclosed display container provides protected movement of merchandise from the point of manufacture to the selling merchant. The merchant markets the goods while protected by an enclosure and the customer is able to identify the product without removing the product from the enclosure. The information panel provides the information the customer needs to chose the correct replacement filter. The filter is easily removed without injury to other filters or the information panel. Although the drawings show air filters, the invention is believed to have application in merchandising other similar thin box shaped articles.

What is claimed is:

1. A container of merchandise comprising:

a box having four vertical rectangular side panels adjoined in series to form four corners and, a flat rectangular bottom, said side panels having upper edges forming a rectangular top opening, a rectangular information panel secured to a pair of adjacent adjoined side panels of said box, said information panel being at a corner of said top opening formed by said pair of adjoined side panels and being spaced from the other side panels of said box and a removable cap covering said top opening, said cap being releasably secured to said box, a plurality of thin stratal positioned rectangular merchandise articles in said container, said articles being individually removable from said box without destruction of said information panel when said cap is removed from said box.

2. The container of claim 1 wherein said information panel includes an edge parallel to said merchandise articles and to one of said other of said side panels of said box and wherein said edge of said information panel is spaced from said one of said other side panels a distance sufficient to permit one of said merchandise articles to be individually removed from said box.

3. The container of claim 1 wherein said merchandise articles are air filter panels for residential heating and cooling systems.

* * * * *